US006783124B2

(12) United States Patent
Tamura et al.

(10) Patent No.: US 6,783,124 B2
(45) Date of Patent: Aug. 31, 2004

(54) PUNCHING DEVICE IN A SHEET FINISHER FOR AN IMAGE FORMING APPARATUS

(75) Inventors: Masahiro Tamura, Kanagawa (JP); Kenji Yamada, Tokyo (JP); Nobuyoshi Suzuki, Tokyo (JP); Shuuya Nagasako, Tokyo (JP); Hiromoto Saitoh, Kanagawa (JP); Hiroki Okada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 18 days.

(21) Appl. No.: 10/279,845

(22) Filed: Oct. 25, 2002

(65) Prior Publication Data

US 2003/0080487 A1 May 1, 2003

(30) Foreign Application Priority Data

Oct. 26, 2001 (JP) ..... 2001-329525

(51) Int. Cl.[7] ..... B65H 37/04

(52) U.S. Cl. ..... 270/58.07; 270/58.17; 83/73; 83/289; 83/358; 83/370

(58) Field of Search ..... 270/58.07, 58.17; 271/227; 83/73, 78, 358, 359, 368, 370, 365, 268, 289, 331

(56) References Cited

U.S. PATENT DOCUMENTS

| | | | | |
|---|---|---|---|---|
| 4,568,866 A | | 2/1986 | Floro et al. | |
| 4,738,442 A | * | 4/1988 | Rodi et al. | 271/261 |
| 4,829,375 A | | 5/1989 | Alzmann et al. | |
| 4,988,085 A | | 1/1991 | Maekawa et al. | |
| 5,263,697 A | | 11/1993 | Yamazaki et al. | |
| 5,508,798 A | | 4/1996 | Yamada | |
| 5,692,411 A | | 12/1997 | Tamura | |
| 5,762,328 A | | 6/1998 | Yamada et al. | |
| 6,042,098 A | * | 3/2000 | Kubota et al. | 270/58.02 |
| 6,145,825 A | | 11/2000 | Kunihiro et al. | |
| 6,199,853 B1 | | 3/2001 | Andoh et al. | |
| 6,231,045 B1 | | 5/2001 | Yamada et al. | |
| 6,264,191 B1 | | 7/2001 | Suzuki et al. | |
| 6,264,194 B1 | * | 7/2001 | Hayashi et al. | 271/220 |
| 6,296,247 B1 | | 10/2001 | Tamura et al. | |
| 6,322,070 B2 | | 11/2001 | Yamada et al. | |
| 6,343,785 B1 | | 2/2002 | Yamada et al. | |
| 6,386,080 B1 | * | 5/2002 | Okamoto et al. | 83/73 |
| 6,394,448 B2 | | 5/2002 | Suzuki et al. | |
| 6,416,052 B2 | | 7/2002 | Yamada et al. | |
| 6,494,449 B2 | | 12/2002 | Tamura et al. | |
| 6,494,453 B1 | | 12/2002 | Yamada et al. | |
| 6,505,829 B2 | * | 1/2003 | Kawata | 271/208 |

FOREIGN PATENT DOCUMENTS

| | | | | |
|---|---|---|---|---|
| EP | 071 271 | | 1/2001 | |
| JP | 9-249348 | | 9/1997 | |
| JP | 10015895 A | * | 1/1998 | B26F/1/08 |
| JP | 10-279170 | | 10/1998 | |
| JP | 2000-153953 | | 6/2000 | |

* cited by examiner

*Primary Examiner*—Patrick Mackey
(74) *Attorney, Agent, or Firm*—Oblon, Spivak, McClelland, Maier & Neustadt, P.C.

(57) ABSTRACT

A sheet finisher for an image forming apparatus of the present invention includes a conveying device for conveying a sheet and a punch unit for punching the sheet being conveyed by the conveying device. A sheet edge sensor senses the edge of the sheet, which is being conveyed by the conveying device, parallel to the direction of sheet conveyance. A drive source moves the sheet edge sensor in a direction perpendicular to the direction of sheet conveyance. Another drive source moves the punch unit in the direction perpendicular to the direction of sheet conveyance in accordance with information output from the sheet edge sensor. A controller controls the two drive sources by a preselected pulse ratio, thereby causing the punch unit to accurately punch the sheet.

18 Claims, 12 Drawing Sheets

PUNCHING DEVICE IN A SHEET FINISHER FOR AN IMAGE FORMING APPARATUS

BACKGROUND OF THE INVENTION

1. Field of the Invention

The present invention relates to a sheet finisher mounted on or operatively connected to a printer, copier, facsimile apparatus or similar image forming apparatus for executing preselected processing with a sheet driven out of the image forming apparatus. More particularly, the present invention relates to a sheet finisher including punching means.

2. Description of the Background Art

A sheet finisher of the type including punching means has customarily been used with an image forming apparatus. The punching means punches sheets sequentially driven out of an image forming apparatus one by one and is therefore free from heavy punching loads. In addition, this type of punching means enhances productivity. However, a problem with such punching means is that if a sheet entered the sheet finisher is skewed, shifted in the horizontal direction or otherwise dislocated, then the hole of the sheet cannot be accurately aligned with the holes of successive sheets.

In order to solve the above problem, there has been proposed a system that corrects the skew of a sheet and, in addition, reads one edge of the sheet parallel to the direction of sheet conveyance and then corrects the shift of the sheet in accordance with the resulting information. More specifically, this system determines the ideal position of a sheet to enter the sheet finisher on the basis of width information sent from an image forming apparatus. The system then compares the ideal position and the actual position of the sheet represented by the output of sheet edge sensing means and corrects a gap between the two positions.

For example, Japanese Patent Laid-Open Publication No. 10-279170 discloses a punching device including sheet edge sensing means responsive to the edge of a sheet, which is being conveyed by conveying means, parallel to the direction of sheet conveyance. First drive means moves the sheet edge sensing means in a direction perpendicular to the direction of sheet conveyance. Second drive means moves punching means in the direction perpendicular to the direction of sheet conveyance in accordance with information output from said sheet edge sensing means and representative of the position of the edge of the sheet. More specifically, the position where the sheet edge sensing means starts moving for sensing the edge of a sheet is set at an edge position parallel to the direction of sheet conveyance in accordance with the sheet size. The punching means is moved in the direction perpendicular to the direction of sheet conveyance on the basis of the edge information, thereby punching consecutive sheets at the same position without lowering image forming speed.

The prior art punching device described above has the following problems left unsolved. The punching device causes punching means and sheet edge sensing means to move integrally with each other and then stops the sheet edge sensing means when it senses the edge of a sheet. Subsequently, the punching device moves the punching means by using the stop position of the sheet edge sensing means as a reference. That is, the reference position for punching is coincident with the edge of a sheet and therefore varies sheet by sheet. Consequently, the punching device needs sophisticated control and is difficult to punch a sheet at an accurate position. Moreover, in the case of a sheet of irregular size not recognized by an image forming apparatus, the punching device cannot see the width of the sheet. As a result, even when the sheet is conveyed in an ideal position, the punching means cannot be moved to the center of the sheet or punch it with accuracy because the ideal position to be compared with the actual edge position is not known.

Technologies relating to the present invention are also disclosed in, e.g., Japanese Patent Laid-Open Publication No. 9-249348.

SUMMARY OF THE INVENTION

It is an object of the present invention to provide a sheet finisher with punching means capable of accurately punching a sheet with simple control.

It is another object of the present invention to provide a sheet finisher with punching means capable of accurately punching a sheet at the center even when the sheet is of irregular size not recognized by an image forming apparatus.

A sheet finisher of the present invention includes a conveying device for conveying a sheet and a punch unit for punching the sheet being conveyed by the conveying device. A sheet edge sensor senses the edge of the sheet, which is being conveyed by the conveying device, parallel to the direction of sheet conveyance. A drive source moves the sheet edge sensor in a direction perpendicular to the direction of sheet conveyance. Another drive source moves the punch unit in the direction perpendicular to the direction of sheet conveyance in accordance with information output from the sheet edge sensor. A controller controls the two drive sources by a preselected pulse ratio, thereby causing the punch unit to accurately punch the sheet.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the sheet finisher in accordance with the present invention will be described hereinafter.

First Embodiment

Figure 1:
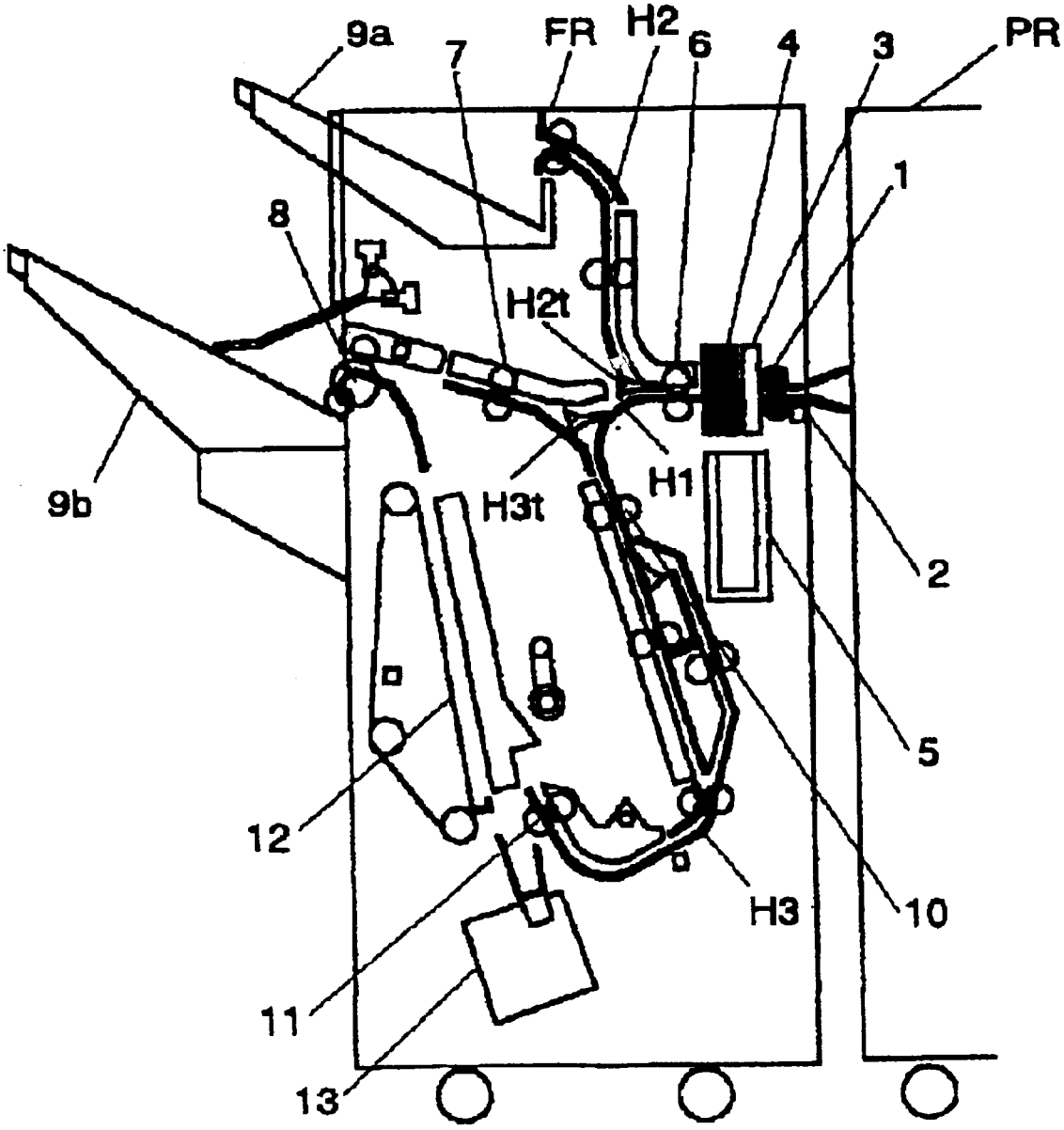
FIG. 1 is a view showing the general construction of a first and a second embodiment of the sheet finisher in accordance with the present invention.

Referring to FIG. 1 of the drawings, a sheet finisher FR embodying the present invention is shown and operatively connected to an image forming apparatus PR. As shown, the sheet finisher FR is generally made up of a punch unit 4, a horizontal path H1, an upper path H2, a lower path H3, a staple tray 12, an upper stack tray 9*a*, and a lower stack tray 9*b*.

A first path selector H2*t* and a second path selector H3*f* are positioned on the horizontal path H1 for selecting the upper path H2 and lower path H3, respectively. The staple tray 12 is positioned on the lower path H2 while a stapler 13 is positioned at the lower end of the staple tray 12. The stapler 13 is capable of stapling sheets sequentially stacked and positioned on the staple tray 12 at the trailing edge of the sheet stack. In addition, a waiting path, not shown, is included in the lower path H2 for allowing a first sheet driven out of the image forming apparatus PR to wait for a moment and be conveyed to the staple tray 12 together with a second sheet and successive sheets.

The stapled sheet stack is lifted away from the staple tray 12 by a hook, not shown, and then driven out to the lower stack tray 9*b* by a belt and an outlet roller pair 8.

The upper stack tray, or proof tray as sometimes referred to, 9*a* is used to stack sheets not subjected to finishing. To guide sheets to the upper stack tray 9*a*, the first path selector H2*t* on the horizontal path H1 is rotated downward (clockwise in FIG. 1) so as to unblock the upper path H2.

The lower stack tray, which bifunctions as a shift tray, 9*b* is configured to separate consecutive sets (copies) of sheets in a sort mode or a stack mode. More specifically, the stack tray 9 is shifted by a preselected amount in the direction perpendicular to the direction of sheet conveyance in order to shift the preceding set of sheets from the following set of sheets. To guide sheets to the stack tray 9, the first and second path selectors H2*t* and H3*t* are rotated to unblock the horizontal path H1 up to the outlet to the stack tray 9. Further, the stack tray 9 is shifted downward little by little as the number of sheets or sheet stacks positioned thereon increases. The downward shift of the stack tray 9 is effected on the basis of the output of a sheet sensor, not shown, responsive to the upper surface of the top sheet positioned on the stack tray 9.

Figure 3:
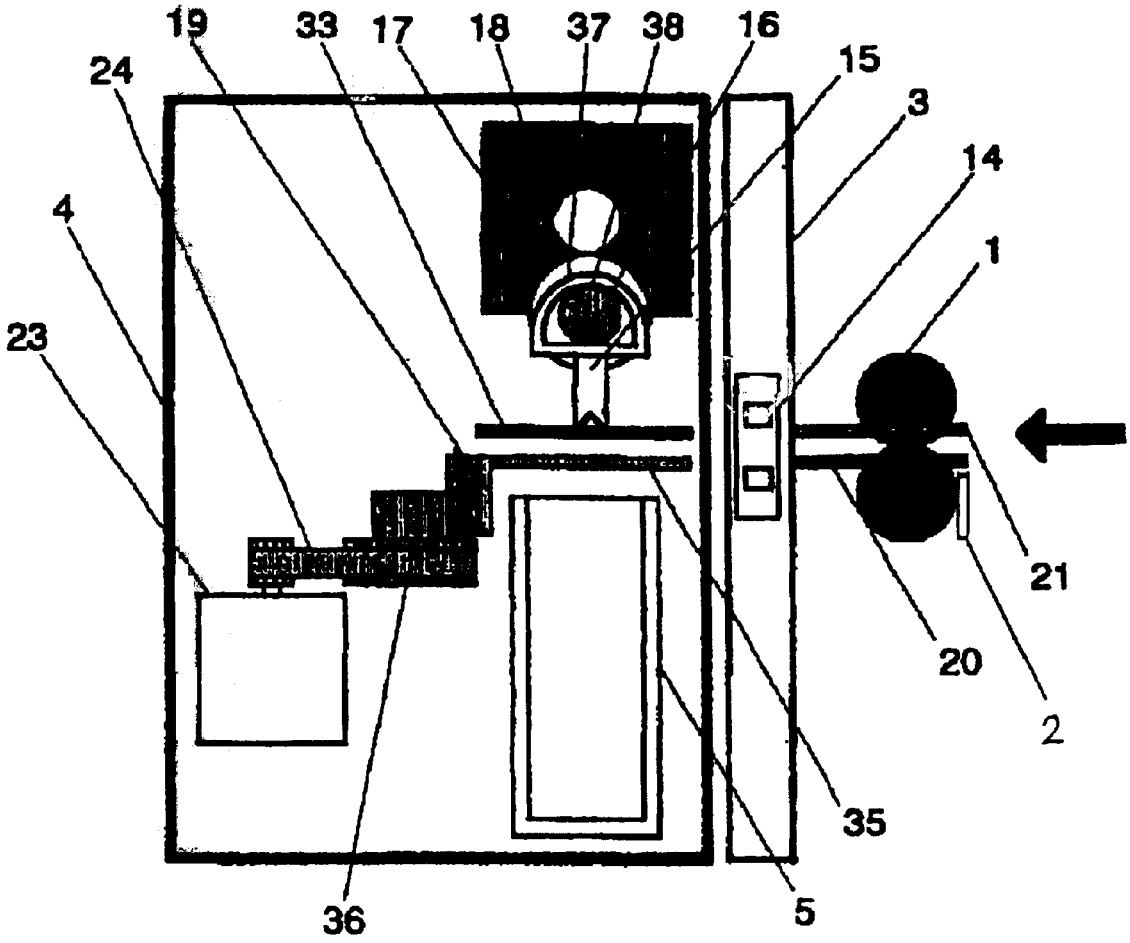
FIG. 3 is a view showing a horizontal registration sensing unit and a punch unit included in the first embodiment.

FIG. 3 shows the most upstream side of the horizontal path H1 in detail. As shown, there are arranged a skew correction roller pair or inlet roller pair 1, an inlet sensor 2, a horizontal registration sensing unit 3, the punch unit 4, and a hopper 5. The horizontal registration sensing unit 3 is positioned upstream of the punch unit 4 in the direction of sheet conveyance. A lower punch guide 20 and an upper punch guide 21 are positioned upstream of the sensing unit 3 in the direction of sheet conveyance. The sensing unit 3 includes a sheet edge sensor 14 responsive to the edge of a sheet parallel to the direction of sheet conveyance.

Figure 4:
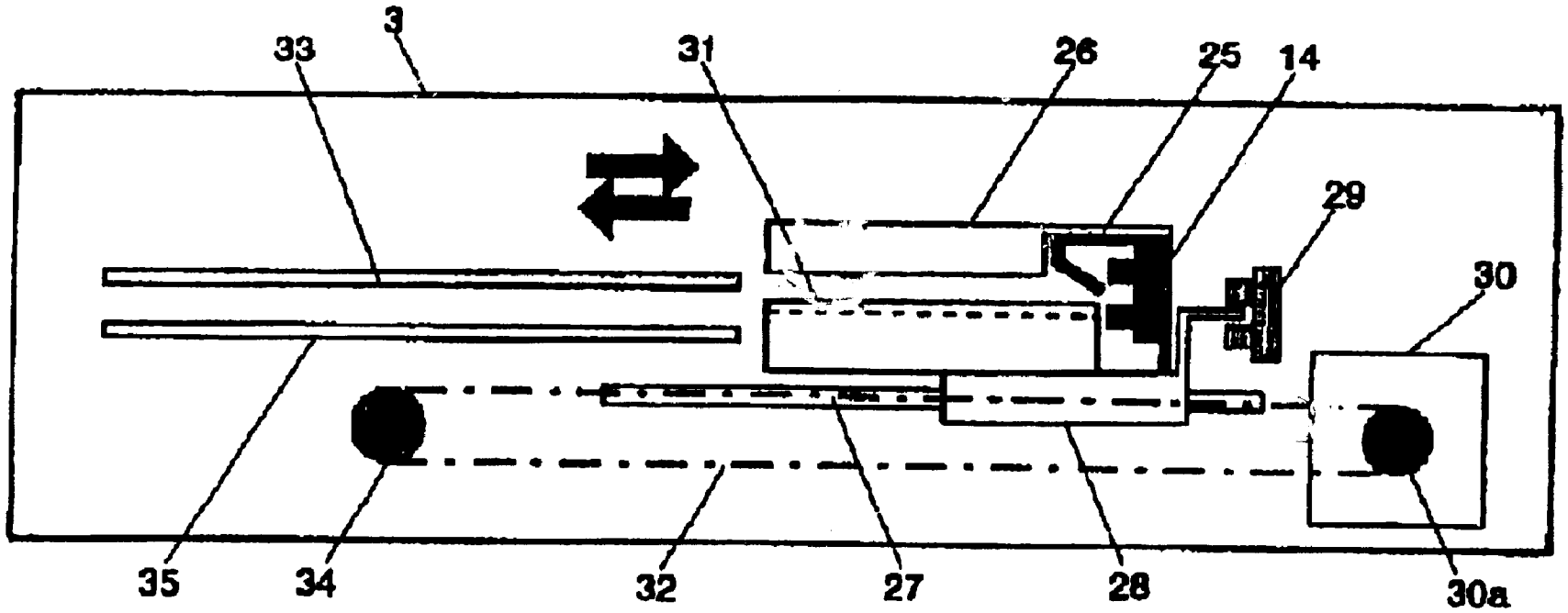
FIG. 4 demonstrates how the horizontal registration sensing unit of the first embodiment senses the edge of a sheet.
Figure 5:
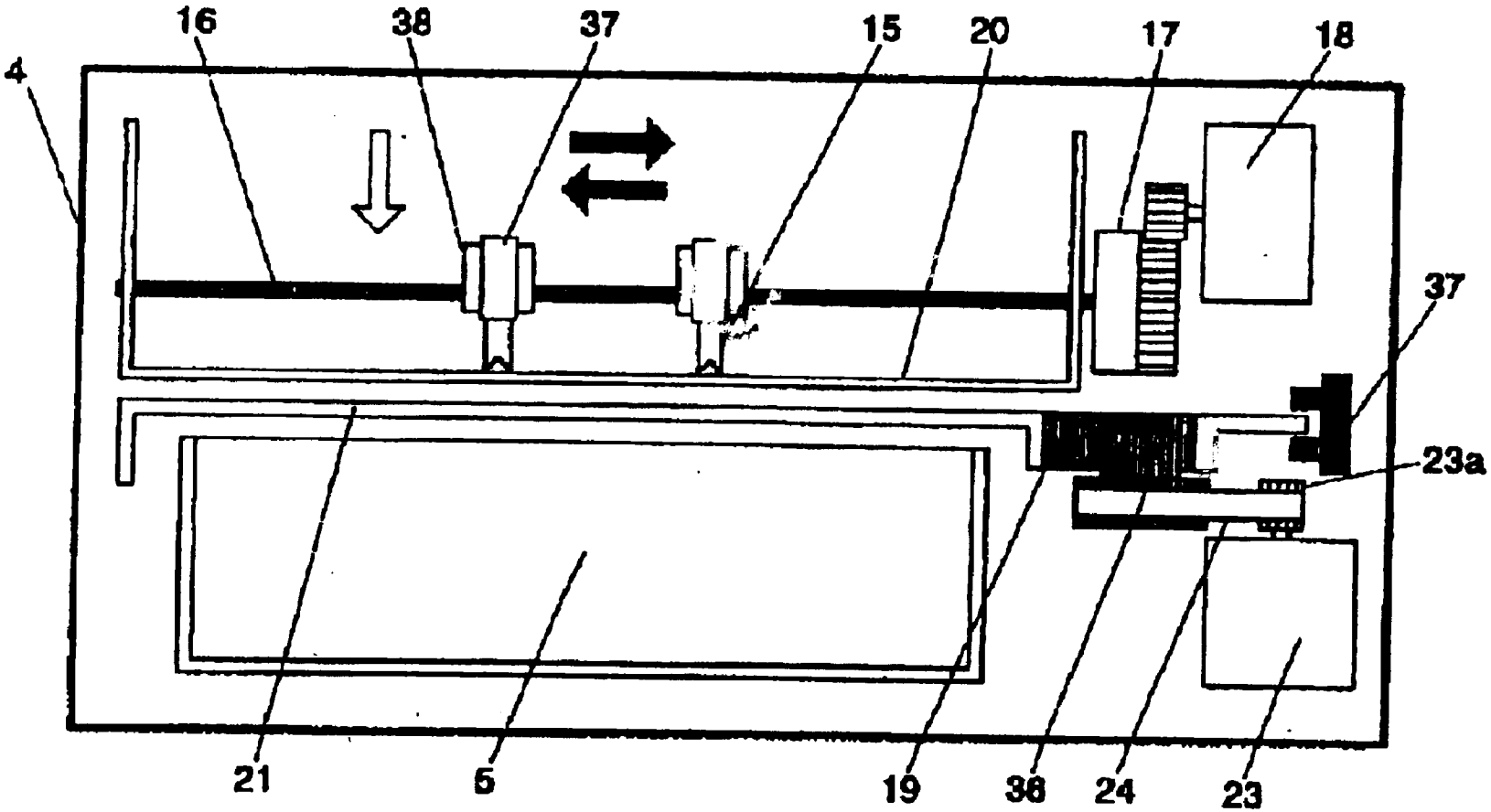
FIG. 5 demonstrates how the punching unit of the first and second embodiments is adjusted in punching position and punches a sheet.

The punch unit 4 includes a punching edge 15 supported by a holder 37 at its upper end. A cam 38 is inserted in the holder 37 and held in contact with a shaft 16 with eccentricity, A motor 18 drives the punching edge 15 via a one-rotation clutch 17. A second stepping motor 23 causes the punching edge 15 to move in the direction perpendicular to the direction of sheet conveyance. A timing belt 24, a gear/pulley 36, a rack 19 and a lower stationary guide 35 are additionally included in the punch unit 4. FIG. 4 shows the horizontal registration sensing unit 3 in a side elevation while FIG. 5 shows the punch unit 4 in a side elevation.

The sheet edge sensor 14 responsive to the edge of a sheet entering the horizontal registration sensing unit 2 is movable in the direction perpendicular to the direction of sheet conveyance (leftward in FIG. 4). As shown in FIG. 4, the sheet edge sensor 14 is mounted on a sheet guide 25, which is mounted on a holder 28 and movable on a shaft 27 in the direction perpendicular to the direction of sheet conveyance (right-and-left direction in FIG. 4). A timing belt 32 is engaged with the holder 28 and passed over a drive pulley 30*a* mounted on the output shaft of a first stepping motor 30 and a driven pulley 34. The first stepping motor 30 causes the timing belt 32 to move between the two pulleys 30*a* and 34. Consequently, the timing belt 32 move the holder 28, sheet guide 25 and sheet edge sensor 14 back and forth in the direction perpendicular to the direction of sheet conveyance.

Part of the holder 28 is configured to define the home position (stand-by position) HP of the sheet edge sensor 14 to which a home position sensor 29 is responsive. The sheet edge sensor 14 moves, when driven by the stepping motor 30 via the timing belt 32, from the home position HP leftward along the shaft 27 for sensing the edge of a sheet parallel to the direction of sheet conveyance.

Figure 6:
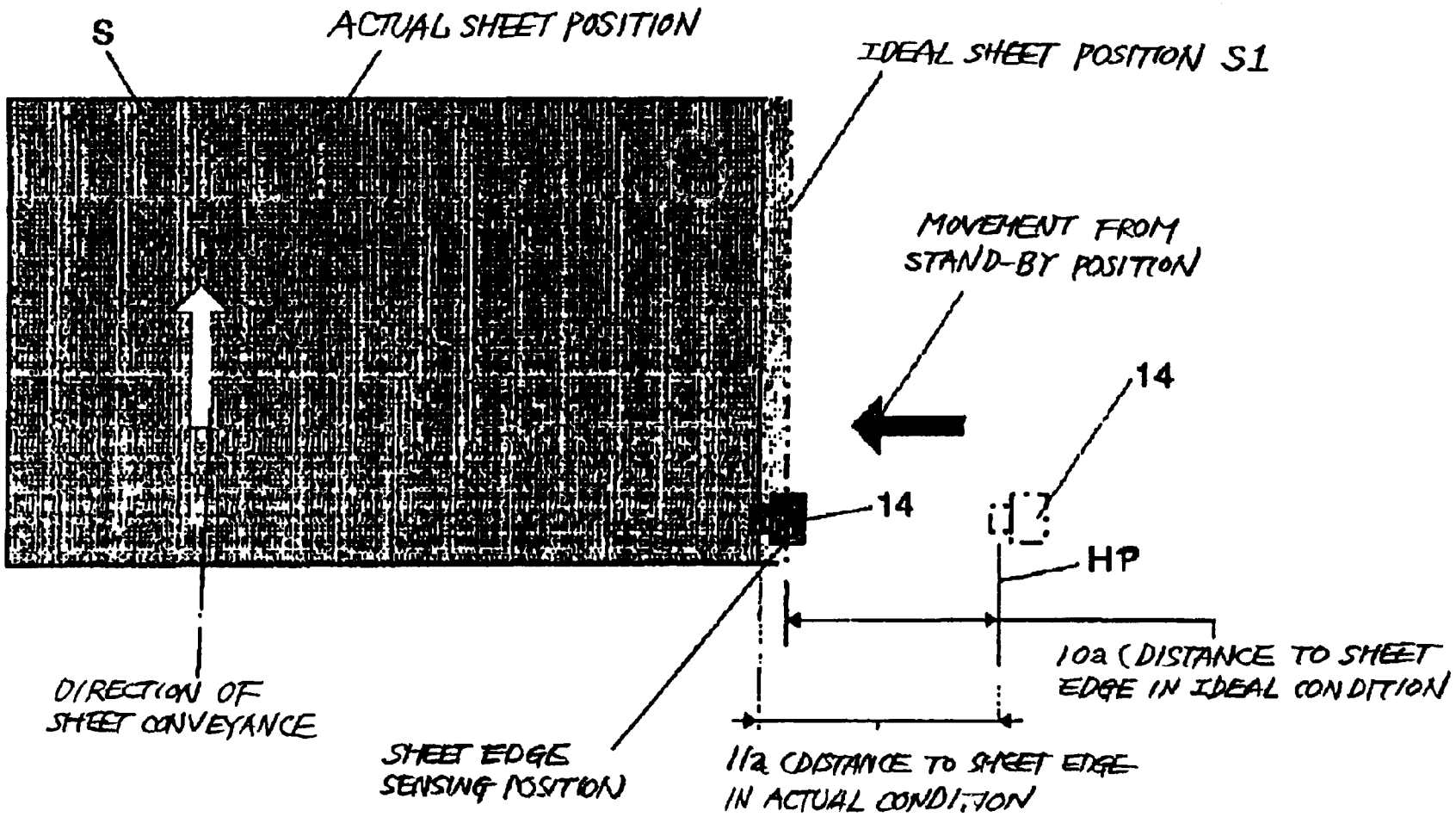
FIG. 6 is a view for describing the operation of the horizontal registration sensing unit of the first embodiment.

FIG. 6 demonstrates how the horizontal registration sensing unit 3 senses the shift or dislocation of a sheet S in the horizontal direction. Assume that the sheet edge sensor 14 moves a distance a for a single pulse of the first stepping motor 30. Also, assume that when the sheet S enters the sensing unit 3 without any shift in the horizontal direction, the sheet edge sensor 14 moves a distance w of 10a from the home position HP until it senses the edge S1 of the sheet S parallel to the direction of sheet conveyance. Then, if the sensor 14 moves a distance of 11a until it actually senses the above edge S1 of the sheet S, the sheet S is shifted in the horizontal direction by a distance expressed as:

$$11a-10a=1a \qquad \text{Eq. (1)}$$

In such a case, it is necessary to move the punch unit 4 in the direction perpendicular to the direction of sheet conveyance (leftward as indicated by an arrow in FIG. 5) in order to correct the above shift 1a.

The punch unit 4 punches the sheet S in the following manner. The motor 18 causes the shaft 16 to make one rotation via the one-rotation clutch 17. It is to be noted that the one-way clutch 17 is coupled on the elapse of a preselected period of time since the trailing edge of the sheet S has moved away from the inlet sensor 2. The shaft 16 in rotation causes the cam 38 contacting it to rotate and move the holder 37 in the up-and-down direction, as indicated by an arrow in FIG. 5. As a result, the punching edge 15 punches the sheet S when lowered in accordance with the movement of the holder 37.

While the illustrative embodiment uses a press-and-punch type of punching system that punches a sheet by stopping the sheet for a moment, such a type of punching system may be replaced with a rotary punching system, if desired. The rotary punching system uses a punching edge and a die mounted on a rotary body and causes them to punch a sheet in accordance with the rotation of the rotary body.

In the illustrative embodiment, it is necessary to move the punch unit 4 in the direction perpendicular to the direction of conveyance in order to correct the shift of the sheet, as stated earlier. For this purpose, the second stepping motor 23 causes the gear/pulley 36 to rotate via the drive pulley 23*a* and timing belt 24. The gear/pulley 36, in turn, causes the rack 19 meshing therewith to move in the right-and-left direction, as viewed in FIG. 5. The rack 19 is mounted on the lower punch guide 21 while the punching edge 15, upper punch guide 20, shaft 16, cam 38, holder 37, clutch 17 and motor 18 all are connected to the lower guide plates 21. Consequently, the rack 19 in movement causes all of such structural members to move in the direction perpendicular to the direction of sheet conveyance together.

Assume that the above structural members moved by the rack 19 move a distance b for a single pulse of the stepping motor 23, and that the distance b is approximate to an integral multiple of the previously stated distance a, e.g., two times as great as the distance a. Then, the distances a and b have the following relation:

$$a=2\times b \qquad \text{Eq. (2)}$$

The shift 1a of the sheet S represented by the Eq. (1) indicates that a shift corresponding to a single pulse has occurred in the horizontal direction. It is therefore necessary to input pulses corresponding to the distance of 1a to the second stepping motor 23. The number of pulses to be input to the second stepping motor is two times as great as the number of pulses corresponding to the shift derived from the sheet edge sensor 14 because of the relation indicated by the Eq. (2).

More specifically, information output from the sheet edge sensor 14 is recognized in terms of pulses and input to a CPU (Central Processing Unit) included in a control circuit, although not shown specifically. The CPU compares the number of pulses with sheet size (width) information to thereby calculate the shift of the sheet S in the horizontal direction. A number of pulses corresponding to the calculated shift are input to the second stepping motor 23, thereby moving the structural members via the rack 19. It is noteworthy that the number of pulses to be input to the second stepping motor 23 is determined by the Eq. (2) and therefore involves a minimum of error, thereby insuring an accurate punching position. Moreover, because the number of pulses to be input to the second stepping motor 23 is determined by the Eq. (2) without regard to the shift, easy software control is achievable.

In the illustrative embodiment, the sheet edge sensor 14 is moved from the home position HP leftward in FIG. 4 in order to sense the edge S1 of the sheet S and then returned to the home position HP before the rack 19 moves the associated members for punching leftward in FIG. 5. More specifically, the sheet edge sensor 14 sensed the edge S1 of the sheet S must be returned to the home position in order to sense the edge of the next sheet S. Therefore, the more rapid the return of the sheet edge sensor 14 to the home position HP, the higher the productivity of the image forming apparatus PR.

The sheet edge sensor 14 must not interfere with the conveyance of the sheet S when located at the home position HP. To cope with various sheet sizes including lengths and widths, it is necessary for the sheet edge sensor 14 to start moving from the home position HP leftward in FIG. 4 along a guide member. Usually, a guide member fixed in place in the movable range of the sheet edge sensor 14 obstructs the movement of the sensor 14. In light of this, in the illustrative embodiment, the upper guide 26 and lower guide 31 are constructed integrally with the sheet edge sensor 14. This allows the sheet edge sensor 14 to move in the above direction while bifunctioning as a guide for stabilizing the conveyance of the sheet S. Further, the upper guide 26 and lower guide 31 move together with the sheet edge sensor 14 while respectively overlapping an upper stationary guide 33 and the lower stationary guide 35, playing the role of a sheet guide.

By sensing the edge of the sheet S and then moving the punch unit 4 in accordance with the position of the sheet edge, as stated above, the illustrative embodiment enhances accurate register of holes formed in consecutive sheets. The sheet S punched at the accurate position is driven out to the lower stack tray 9*b* by the outlet roller pair 8 via a roller pair 7 on the horizontal path H1. At this instant, in a shift mode, the stack tray 9*b* may be moved back and forth in the direction perpendicular to the direction of sheet conveyance in order to classify the consecutive sheets or sheet stacks.

In a staple mode, the first and second path selectors H2*t* and H3*t* are so positioned as to steer the sheet S to the lower path H3. A roller pair 10 conveys the sheet S entered the lower path H3 toward the staple tray 12. Such sheets S are sequentially stacked and positioned on the staple tray 12 and then stapled together by the stapler 13. Further, consecutive sheets S will be simply driven out to the upper stack tray 9*a* without any finishing if the first path selector H2*t* is so positioned. Wastes derived from punched sheets S are collected in the hopper 5 shown in FIGS. 3 and 5.

Figure 2:
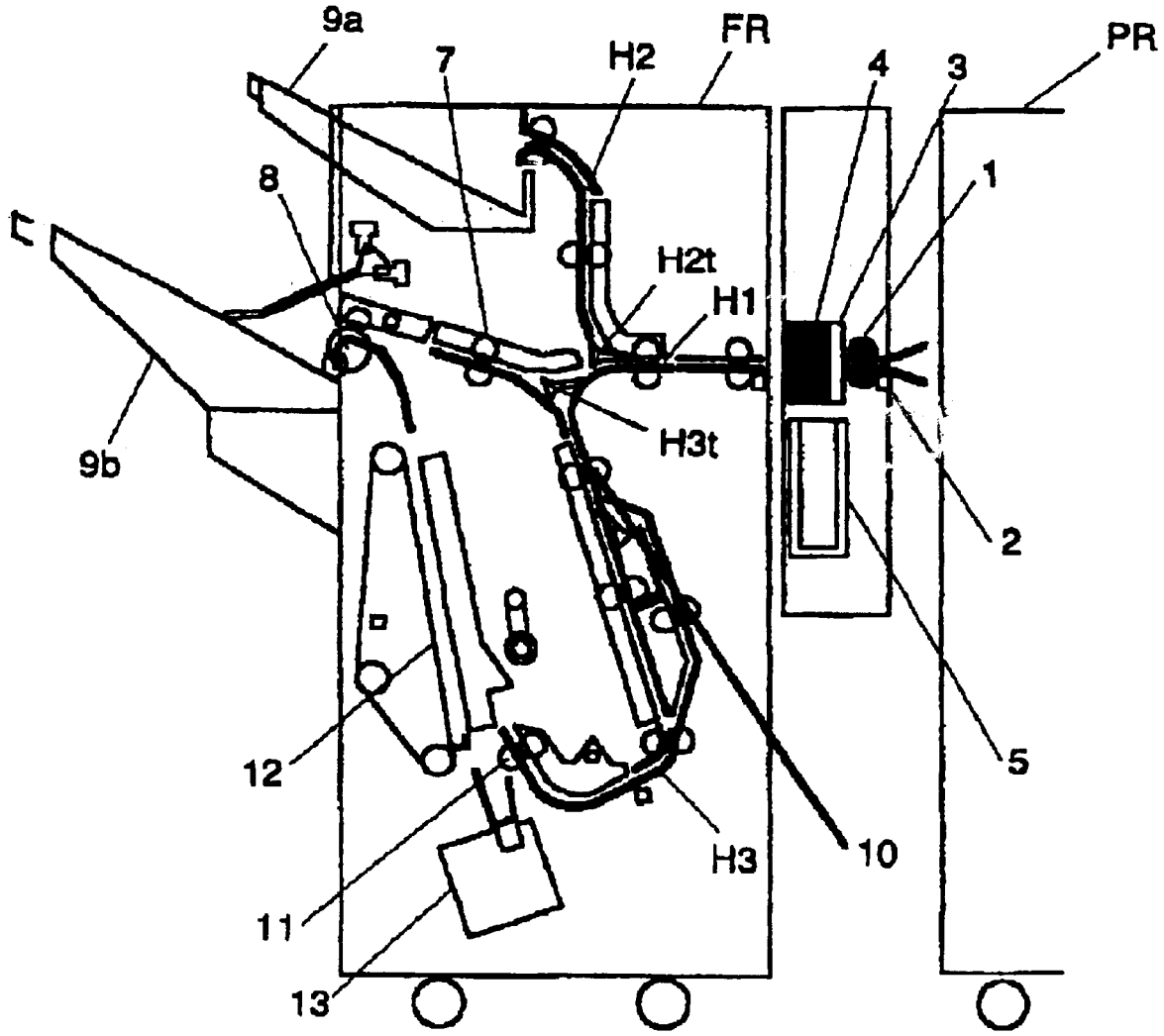
FIG. 2 is a view showing a modification of either one of the first and second embodiments.

FIG. 2 shows a modification of the illustrative embodiment in which the punching device is positioned upstream of the sheet finisher FR in the direction of sheet conveyance. As shown, the punch unit 4 may be constructed independently of the sheet finisher FR and positioned upstream of the sheet finisher FR in the direction of sheet conveyance, i.e., between the image forming apparatus PR and the finisher FR. In this modification, the horizontal registration sensing unit 3 and punch unit 4 shown in FIGS. 3 through 5 are constructed into a unit intervening between the image forming apparatus PR and the sheet finisher FR. As for the rest of the construction, the modification is identical with the illustrative embodiment except that the inlet roller pair 1 is positioned at the most upstream side of the horizontal path H1 in the direction of sheet conveyance.

Second Embodiment

A second embodiment of the present invention will be described with reference to FIGS. 7 through 12. Briefly, a second embodiment of the present invention differs from the first embodiment in that it senses opposite edges of the sheet S parallel to the direction of sheet conveyance and then sets a punching position on the basis of the position of one of the opposite edges sensed. The sheet finisher FR itself and the system of the second embodiment are identical with those of the first embodiment and will not be described specifically in order to avoid redundancy. Also, structural elements of the second embodiment identical with those of the first embodiment are designated by identical reference numerals and will not be described specifically.

As shown in FIGS. 7 through 12, the sheet edge sensor 14 responsive to the edge of the sheet S entering the horizontal registration sensing unit 3 is movable in the direction perpendicular to the direction of sheet conveyance (leftward in FIG. 8), as in the first embodiment. The sheet edge sensor 14 is mounted on the holder 28, which is movable on the shaft 27 in the direction perpendicular to the direction of sheet conveyance (right-and-left direction in FIG. 8). The timing belt 32 is engaged with the holder 28 and passed over the drive pulley 30*a* mounted on the output shaft of the first stepping motor 30 and the driven pulley 34. The first stepping motor 30 causes the timing belt 32 and therefore the holder 28 and sheet edge sensor 14 to move.

Part of the holder 28 is configured to define a first home position (stand-by position) HP1 of the sheet edge sensor 14 to which a HP sensor 29 senses. The first stepping motor 30 causes the sheet edge sensor 14 to move along the shaft 27 from the stand-by position HP1 leftward, as viewed in FIG. 8, via the intermediate members, so that the sensor 14 senses opposite edges S1 and S2 of the sheet S parallel to the direction of sheet conveyance.

Figure 7:
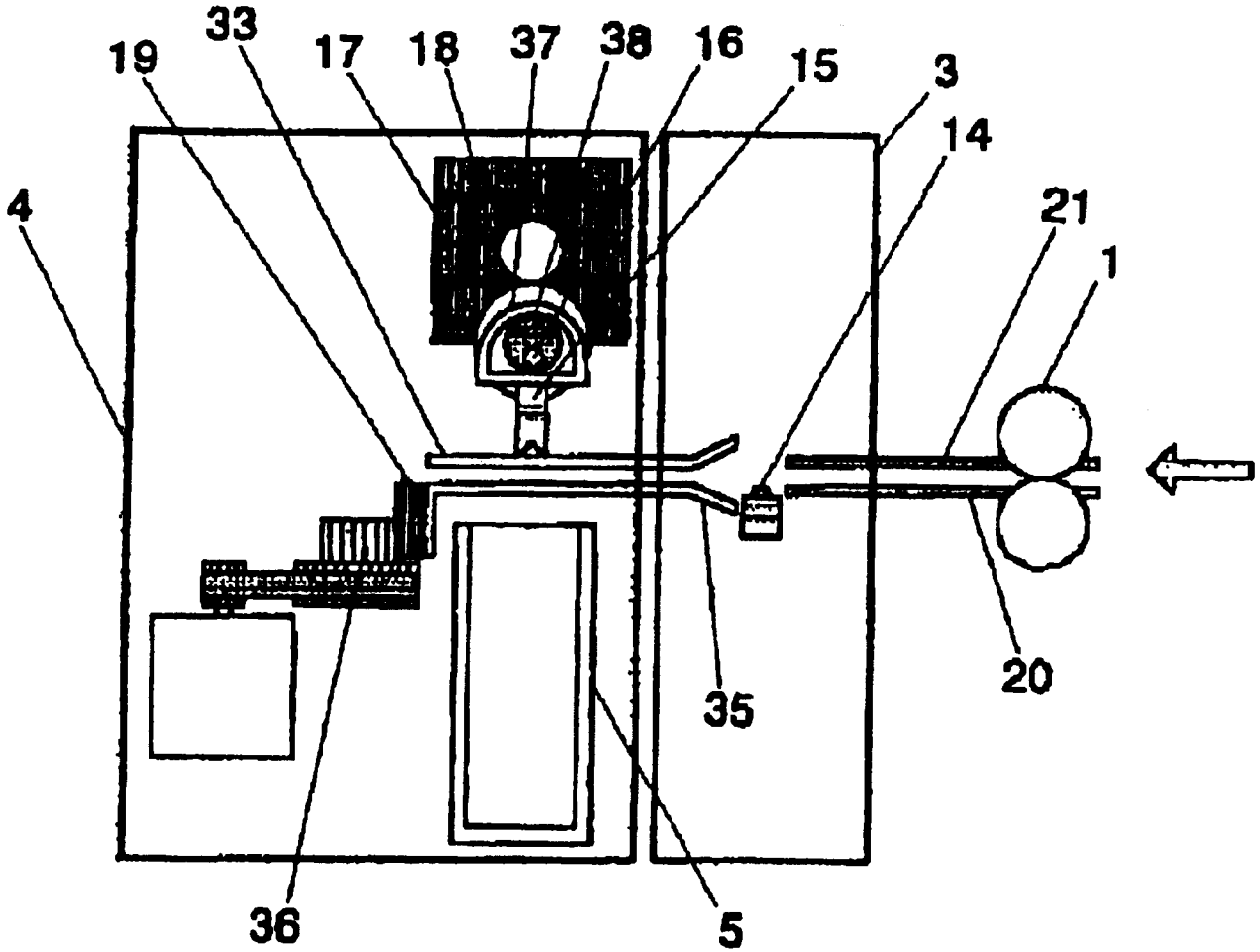
FIG. 7 is a view showing a horizontal registration sensing unit and the punching unit of the second embodiment.
Figure 8:
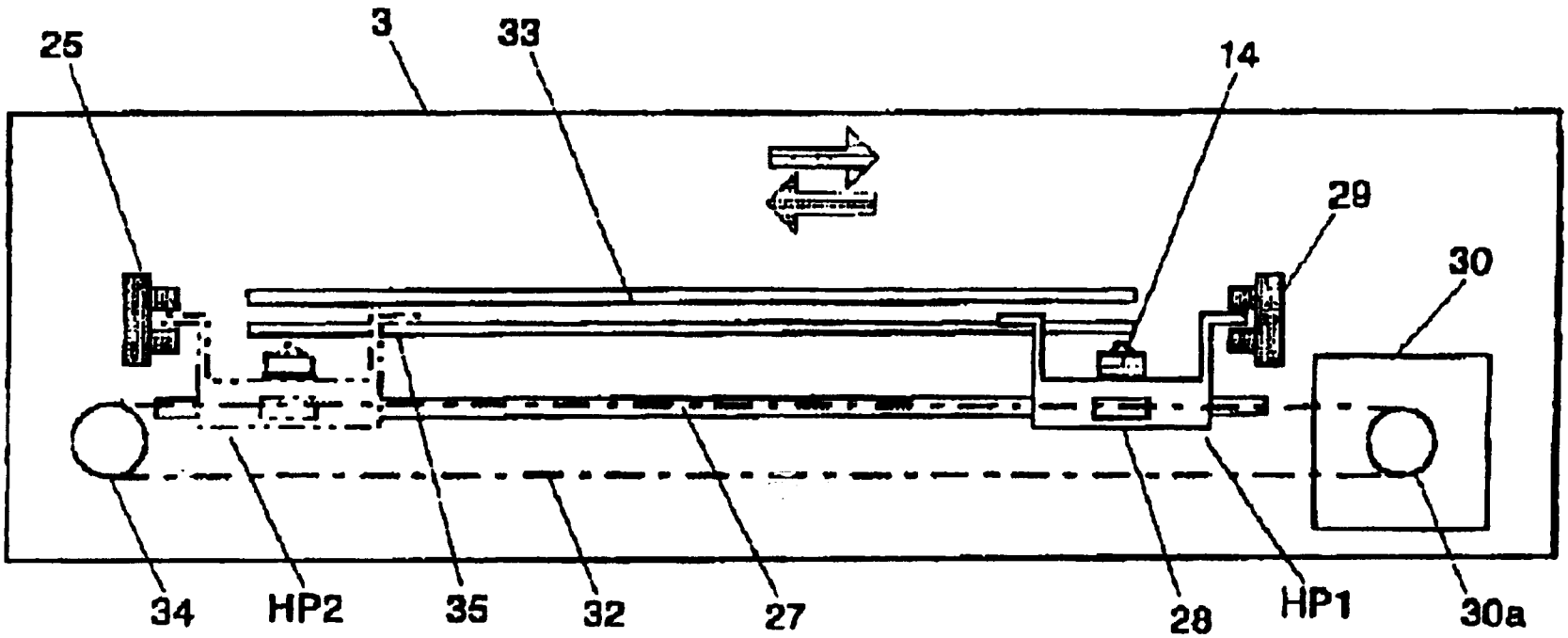
FIG. 8 demonstrates the operation of the horizontal registration sensing unit of the second embodiment that uses a single sheet edge sensor.

As shown in FIG. 7, the horizontal registration sensing unit 3 intervenes between the upper and lower punch guides 33 and 35 and the upper and lower inlet guides 21 and 20. As shown in FIG. 8, the sheet edge sensor 14 moves over the entire range covered by the upper and lower punch guides 33 and 35, i.e., over the entire width of the sheet S between the edges S1 and S2 of the sheet S (see FIG. 10). The sheet edge sensor 14 can therefore read even the width, i.e., opposite edges of a sheet of irregular size not recognized by the image forming apparatus PR.

Figure 10:
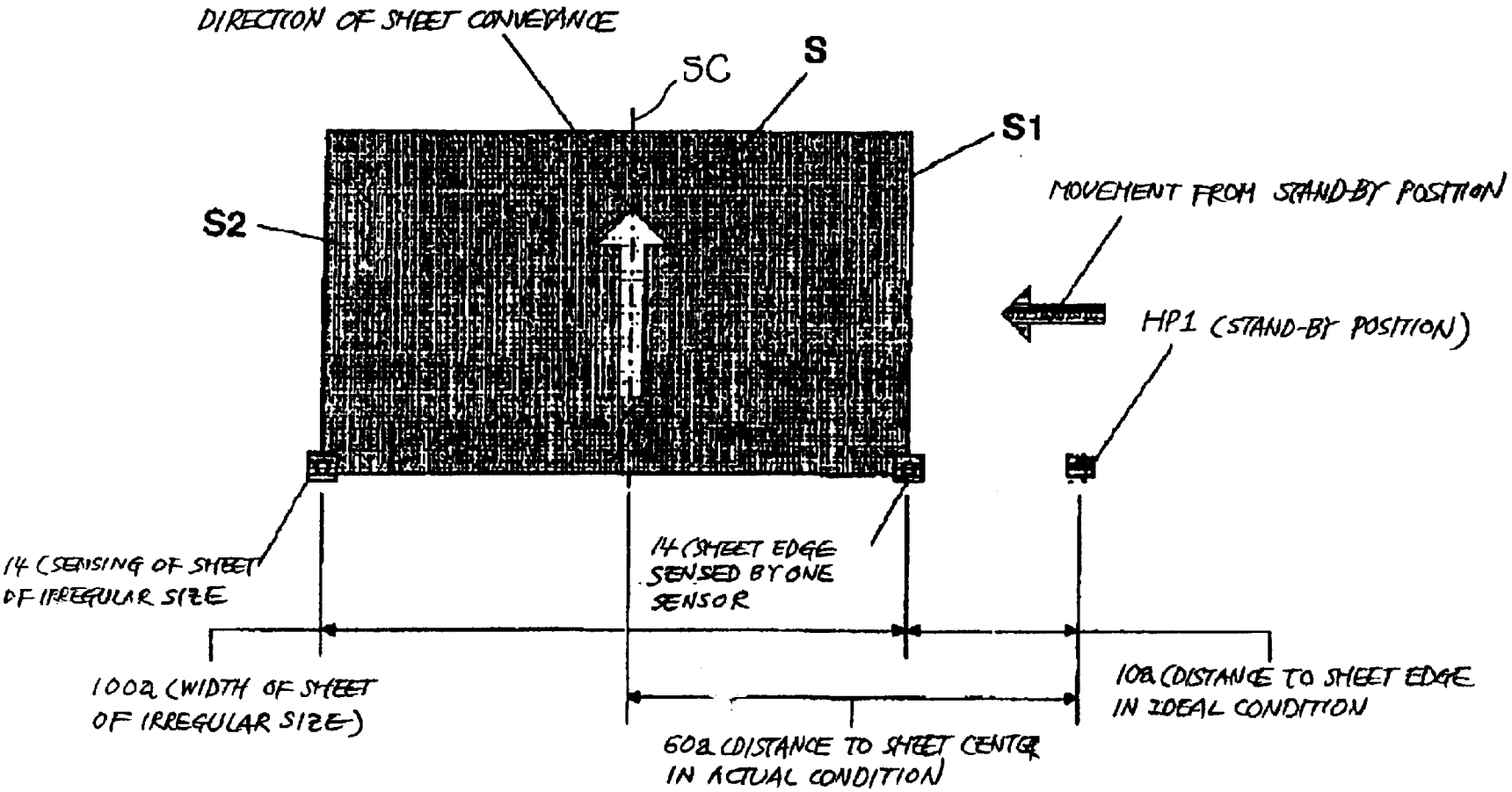
FIG. 10 is a view for describing the operation of the horizontal registration sensing unit shown in FIG. 8.
Figure 11:
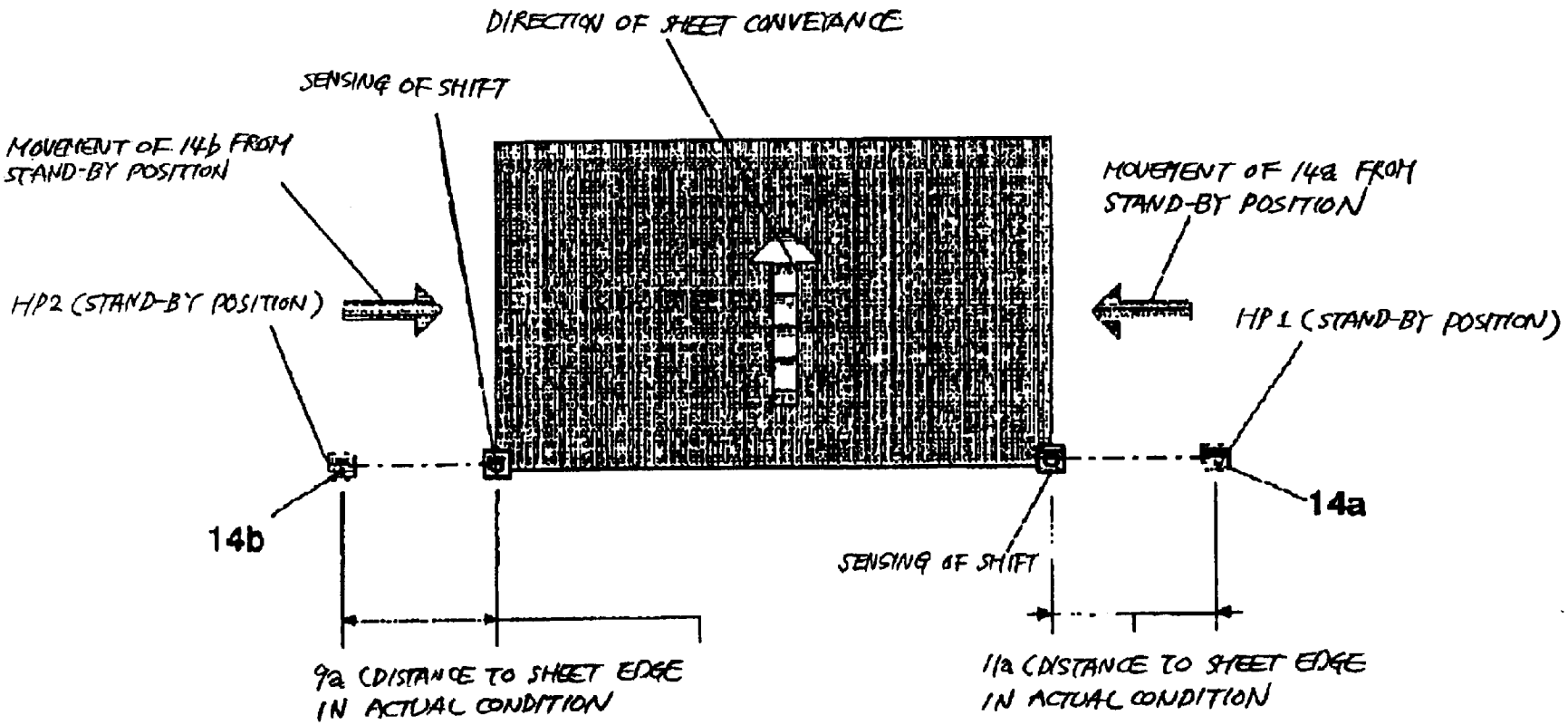
FIG. 11 is a view for describing the operation of the horizontal registration sensing unit shown in FIG. 9.

Reference will be made to FIG. 10 for describing a specific procedure that the illustrative embodiment executes when the sheet S entered the horizontal registration sensing unit 3 via the screw correction roller pair 1 is of an irregular size not recognized by the image forming apparatus PR. Assume that the sheet edge sensor 14 moves a distance a for a single pulse of the first stepping motor 30. If the sheet S is of irregular size not recognized by the image forming apparatus PR, then the positions of the opposite edges S1 and S2 of the sheet S (width) are not known. In light of this, the sheet edge sensor 14 moves from the stand-by position HP1 to the left in FIG. 10.

Assume that the sheet edge sensor 14 moves a distance of 10a until it senses one edge S1 of the sheet S and then moves a distance of 100a until it senses the other edge S2 of the sheet S. Then, the distances the sheet edge sensor 14 moved to the opposite edges S1 and S2 can be determined. It follows that the distance between the stand-by position HP1 and the center SC of the sheet S being conveyed is determined to be 60a. By using this distance, it is possible to calculate the shift or difference of the center SC of the sheet S from the reference center of a sheet to be accurately conveyed without any shift in the horizontal direction. Subsequently, the punch unit 4 is moved by a distance based on the above shift of horizontal registration, so that the punching edge 15 can accurately punch the sheet S at the expected position. That is, the punch unit 4 can be located at a position where the shift of the horizontal registration is corrected.

In FIG. 8, assume that another sheet S enters the horizontal registration sensing unit 3 after the sheet edge sensor 14 moved from the stand-by position HP1 has sensed the edges S1 and S2 of the previous sheet S. Then, the sheet edge sensor 14 may be moved from the second home position SP2 to which the second home position sensor 25 is responsive rightward, as viewed in FIG. 8, to thereby sense the opposite edges of the following sheet S. This allows the sheet edge sensor 14 to efficiently sense the edges of the consecutive sheets S with respect to time. Even if the second home position sensor 25 is not used, the sheet edge sensor 14 can be alternately moved from the opposite home positions HP1 and HP2 if the number of pulses input to the first stepping motor 30 is stored.

Figure 9:
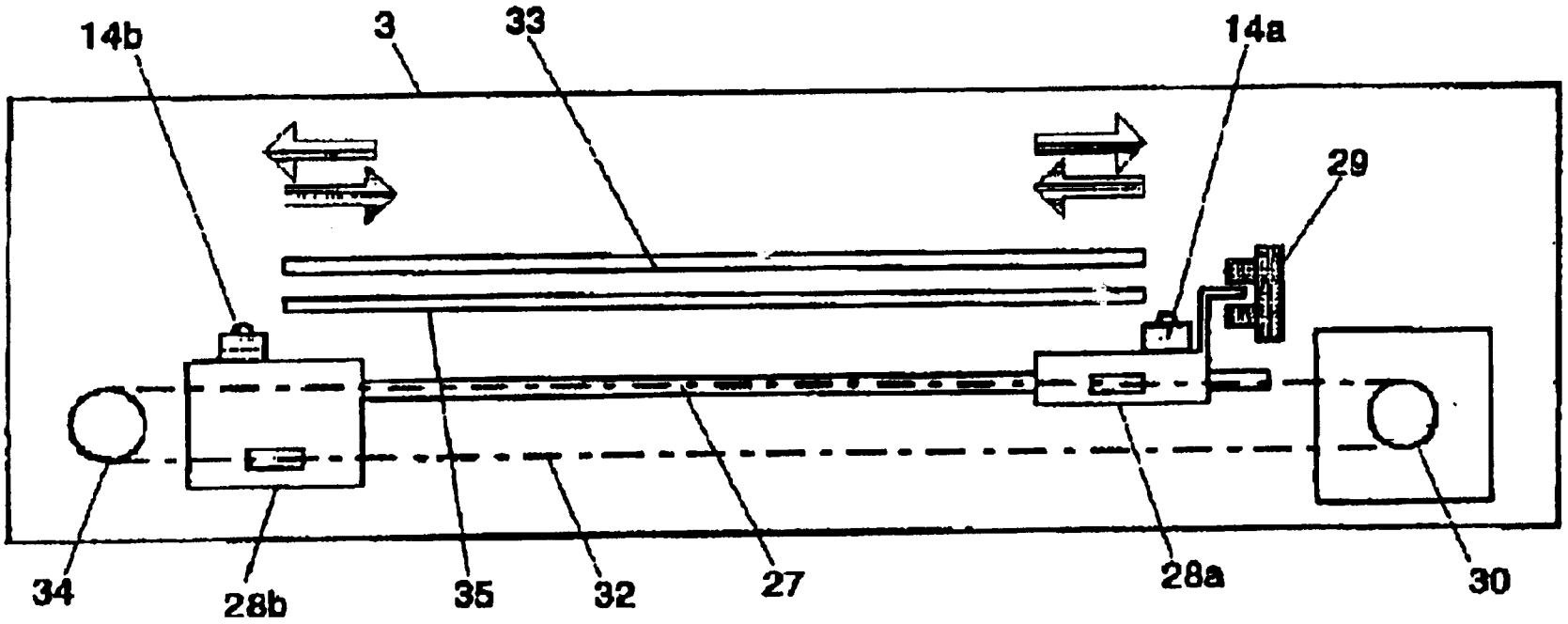
FIG. 9 is a view similar to FIG. 8, demonstrating the operation of the horizontal registration sensing unit of the second embodiment that uses two sheet edge sensors.

FIG. 9 shows another specific configuration of the horizontal registration sensing unit 3. As shown, the single sheet edge sensor 14 shown in FIG. 8 is replaced with a first and a second sheet edge sensor 14*a* and 14*b* respectively responsive to the edges S1 and S2 of the sheet S. The two sheet edge sensors 14*a* and 14*b* are respectively mounted on a first and a second holder 28*a* and 28*b*, which are movable on the shaft 27 in the direction perpendicular to the direction of sheet conveyance. The holders 28*a* and 28*b* are respectively fixed to the upper run and the lower run of the timing belt 32 and therefore move toward each other (inward arrows in FIG. 9) or away from each other (outward arrows in FIG. 9).

The timing belt 32 is passed over the drive timing pulley 30*a* of the first stepping motor 30 and the driven timing pulley 34 and caused to move by the stepping motor 30. The home positions (stand-by positions) HP1 and HP2 of the sheet edge sensors 14*a* and 14*b*, respectively, are defined by part of the configuration of the first holder 28*a* to which the home position sensor 29 is responsive. To sense the edges S1 and S2 of the sheet S, the sheet edge sensors 14*a* and 14*b* are moved from their home positions HP1 and HP2, respectively, by the first stepping motor 30, as indicated by inward arrows. The sheet edge sensors 14*a* and 14*b* can therefore read even the shift of the sheet S of irregular size not recognized by the image forming apparatus RP Reference will be made to FIG. 11 for describing a specific procedure that the configuration of FIG. 10 executes when the sheet S entered the horizontal registration sensing unit 3 via the screw correction roller pair 1 is of irregular size not recognized by the image forming apparatus PR. Assume that the sheet edge sensors 14 each move a distance a for a single pulse of the first stepping motor 30. Because the sheet S is of irregular size not recognized by the image forming apparatus PR, the positions of the opposite edges S1 and S2 of the sheet S (width) are not known. Assume that the first sheet edge sensor 14*a* moves from the stand-by position HP1 by a distance of 11a until it senses one edge S1 of the sheet S while the second sheet edge sensor 14*b* moves from the stand-by position HP2 by a distance of 9a until it senses the other edge S2 of the sheet S. Then, the difference between the two distances is 11a−9a=2a. Therefore, if the stand-by positions HP1 and HP2 are spaced by the same distance from the center of conveyance of the sheet S, then the sheet S is shifted in the horizontal direction by 1a, which is one-half of the above difference 2a.

The two sheet edge sensors 14*a* and 14*b* both are moved toward and away from each other by a single stepping motor 30. Therefore, even after the sheet edge sensor 14*b* has sensed the edge S2 of the sheet S on moving the distance of 9a from the home position HP2, the stepping motor 30 continuously rotates. Subsequently, the sheet edge sensor 14*b* stops moving when the sheet edge sensor 14*a* senses the edge S1 of the sheet S. This not only reduces cost with a single drive source, but also obviates time losses because the two sensors 14*a* and 14*b* start moving at the same time.

Information output from the sheet edge sensors 14*a* and 14*b* are input to the CPU of the control circuit. In response, the CPU controls the number of pulses to be input to the second stepping motor 23 in the same manner as in the previous embodiment, thereby accurately locating the punch unit 4.

As for the configuration and operation of the punch unit 4, the illustrative embodiment is identical with the previous embodiment.

After determining the shift of the sheet S from the reference center free from shift with the two sheet edge sensors 14*a* and 14*b*, the illustrative embodiment adds the shift to the distance of movement of the punch unit 4 for thereby locating two punching edges 15 symmetrically with respect to the center SC of the sheet S being conveyed. This will be described more specifically with reference to FIG. 12.

Figure 12:
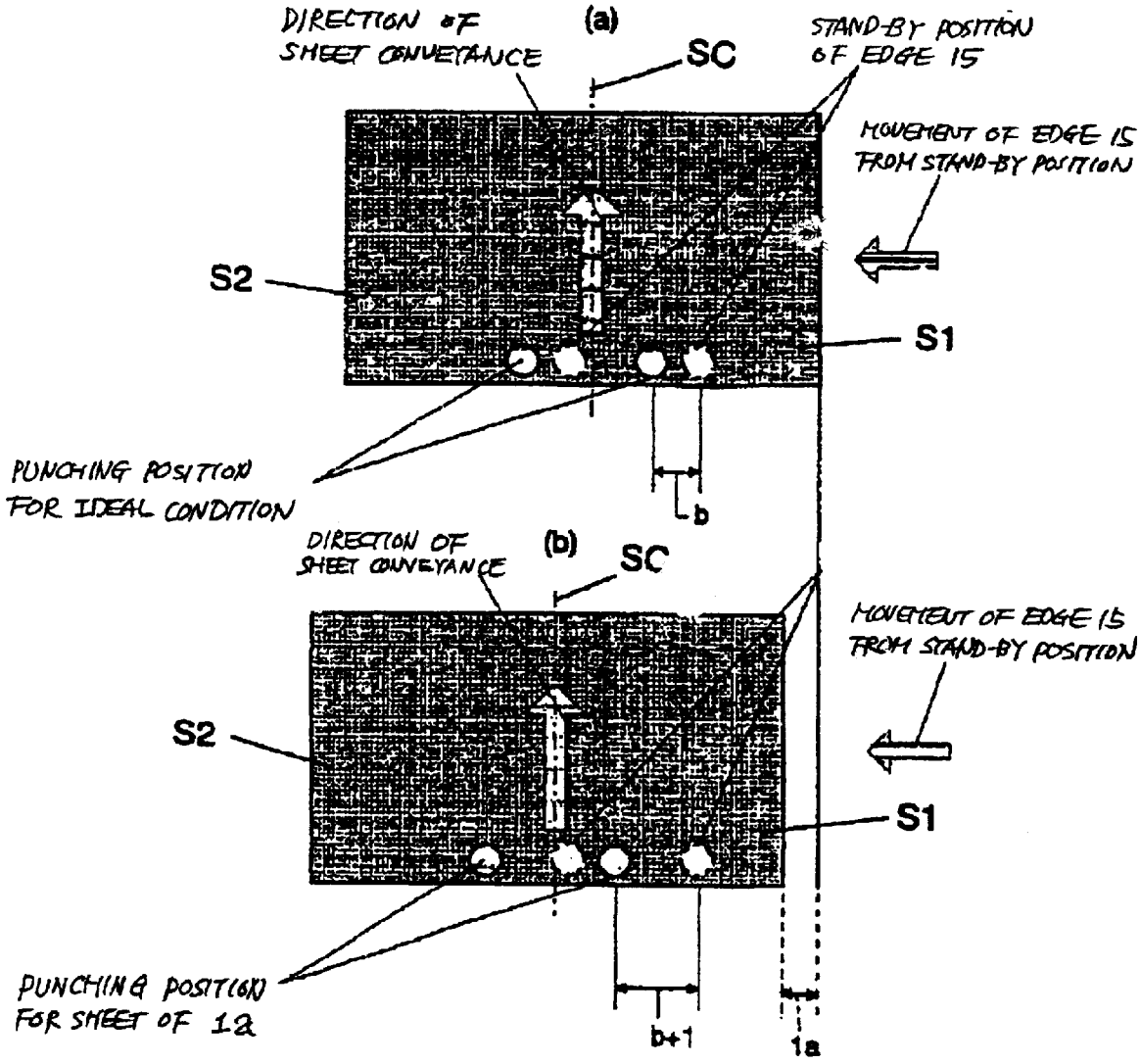
FIG. 12 is a view showing how the punching unit of the second embodiment is adjusted in punching position.

As shown in FIG. 12, (a), assume that when the sheet S is free from shift in the horizontal direction, each punching edge 15 is moved from its stand-by position by a distance of b. Then, if the punching edges 15 each are moved by the distance of b from the respective stand-by position, they can punch the sheet S at symmetrical positions with respect to the center SC of the sheet S. Therefore, as shown in FIG. 12, (b), when the sheet S is shifted by 1a in the horizontal direction, the punching edges 15 each are moved from the stand-by position by a distance of (b+1a) to thereby punch the sheet S at symmetrical positions with respect to the center SC of the sheet S. The illustrative embodiment can punch even a sheet of irregular size at an accurate position.

The illustrative embodiment can execute various modes including the shift mode and staple mode like the previous embodiment. In the staple mode, the waste of the sheet S produced by punching is collected in the hopper 5 shown in FIGS. 3 and 5.

In summary, it will be seen that the present invention provides a sheet finisher capable of insuring accurate punching with simple control by driving first and second drive means with a preselected pulse ratio. Further, sheet edge sensing means senses opposite edges of a sheet parallel to the direction of sheet conveyance, so that even a sheet of irregular size not recognized by an image forming apparatus can be accurately punched at its center.

Various modifications will become possible for those skilled in the art after receiving the teachings of the present disclosure without departing from the scope thereof.

What is claimed is:

1. A sheet finisher comprising:

conveying means for conveying a sheet;

punching means for punching the sheet being conveyed by said conveying means;

sheet edge sensing means for detecting a horizontal shift of the sheet by sensing an edge parallel to a direction of sheet conveyance of the sheet, being conveyed by said conveying means;

first drive means for moving said sheet edge sensing means in a direction perpendicular to the direction of sheet conveyance;

second drive means for moving said punching means in the direction perpendicular to the direction of sheet conveyance such that a position of said punching means is adjusted in accordance with a horizontal shift of the sheet calculated based on the detected horizontal shift of the sheet detected by said sheet edge sensing means; and control means for controlling said first drive means and said second drive means by a preselected pulse ratio.

2. The sheet finisher as claimed in claim 1, wherein said sheet edge sensing means is constructed integrally with a guide member configured to guide the sheet, said guide member being movable integrally with said sheet edge sensing means.

3. A sheet finisher comprising:

conveying means for conveying a sheet;

punching means for punching the sheet being conveyed by said conveying means;

sheet edge sensing means for detecting a horizontal shift of the sheet by sensing an edge parallel to a direction of sheet conveyance of the sheet being conveyed by said conveying means;

first drive means for moving said sheet edge sensing means in a direction perpendicular to the direction of sheet conveyance;

second drive means for moving said punching means in the direction perpendicular to the direction of sheet conveyance such that a position of said punching means is adjusted in accordance with a horizontal shift of the sheet calculated based on the detected horizontal shift of the sheet detected by said sheet edge sensing means; and control means for controlling said first drive means and said second drive means;

wherein when said sheet edge sensing means has sensed the edge of the sheet, said control means returns said sheet edge sensing means to a stand-by position.

4. The sheet finisher as claimed in claim 3, wherein said sheet edge sensing means is constructed integrally with a guide member configured to guide the sheet, said guide member being movable integrally with said sheet edge sensing means.

5. A sheet finisher comprising:

conveying means for conveying a sheet;

punching means for punching the sheet being conveyed by said conveying means;

sheet edge sensing means for detecting a horizontal shift of the sheet by sensing an edge parallel to a direction of sheet conveyance of the sheet being conveyed by said conveying means;

first drive means for moving said sheet edge sensing means in a direction perpendicular to the direction of sheet conveyance;

second drive means for moving said punching means in the direction perpendicular to the direction of sheet conveyance such that a position of said punching means is adjusted in accordance with a horizontal shift of the sheet calculated based on the detected horizontal shift of the sheet detected by said sheet edge sensing means; and control means for controlling said first drive means and said second drive means;

wherein said sheet edge sensing means senses opposite edges of the sheet parallel to the direction of sheet conveyance.

6. The sheet finisher as claimed in claim 5, wherein said first drive means causes said sheet edge sensing means to move over an entire width of the sheet in the direction perpendicular to the direction of sheet conveyance for thereby sensing the opposite edges of the sheet.

7. The sheet finisher as claimed in claim 5, wherein said sheet edge sensing means starts sensing edges of a next sheet at a position where said sheet edge sensing means sensed a second edge of a previous sheet.

8. The sheet finisher as claimed in claim 5, wherein said sheet edge sensing means comprises two sheet edge sensing means located outside of the opposite edges of the sheet.

9. The sheet finisher as claimed in claim 8, wherein said first drive means drives said two sheet edge sensing means at the same time.

10. A sheet finisher comprising:

a sheet conveyer configured to convey a sheet;

a punching unit configured to punch the sheet;

a sheet edge sensor configured to detect a horizontal shift of the sheet by sensing an edge parallel to a direction of sheet conveyance of the sheet;

a first motor configured to move said sheet edge sensor in a direction perpendicular to the direction of sheet conveyance;

a second motor configured to move said punching unit in the direction perpendicular to the direction of sheet conveyance such that a position of said punching unit is adjusted in accordance with a horizontal shift of the sheet calculated based on the detected horizontal shift; and a control circuit configured to control said first and second motors by a pre-selected pulse ratio.

11. The sheet finisher as claimed in claim 10, wherein said sheet edge sensor is constructed integrally with a guide member configured to guide the sheet, said guide member being movable integrally with said sheet edge sensor.

12. A sheet finisher comprising:

a sheet conveyer configured to convey a sheet;

a punching unit configured to punch the sheet;

a sheet edge sensor configured to detect a horizontal shift of the sheet by sensing an edge parallel to a direction of sheet conveyance of the sheet;

a first motor configured to move said sheet edge sensor in a direction perpendicular to the direction of sheet conveyance;

a second motor configured to move said punching unit in the direction perpendicular to the direction of sheet conveyance such that a position of said punching unit is adjusted in accordance with a horizontal shift of the sheet calculated based on the detected horizontal shift; and a control circuit configured to control said first and second motors;

wherein when said sheet edge sensor has sensed the edge of the sheet, said control circuit returns said sheet edge sensor to a stand-by position.

13. The sheet finisher as claimed in claim 12, wherein said sheet edge sensor is constructed integrally with a guide member configured to guide the sheet, said guide member being movable integrally with said sheet edge sensor.

14. A sheet finisher comprising:

a sheet conveyer configured to convey a sheet;

a punching unit configured to punch the sheet;

a sheet edge sensor configured to detect a horizontal shift of the sheet by sensing an edge parallel to a direction of sheet conveyance of the sheet;

a first motor configured to move said sheet edge sensor in a direction perpendicular to the direction of sheet conveyance;

a second motor configured to move said punching unit in the direction perpendicular to the direction of sheet conveyance such that a position of said punching unit is adjusted in accordance with a horizontal shift of the sheet calculated based on the detected horizontal shift; and a control circuit configured to control said first and second motors;

wherein said sheet edge sensor senses opposite edges of the sheet parallel to the direction of sheet conveyance.

15. The sheet finisher as claimed in claim 14, wherein said first motor causes said sheet edge sensor to move over an entire width of the sheet in the direction perpendicular to the direction of sheet conveyance for thereby sensing the opposite edges of the sheet.

16. The sheet finisher as claimed in claim 14, wherein said sheet edge sensor starts sensing edges of a next sheet at a position where said sheet edge sensor sensed a second edge of a previous sheet.

17. The sheet finisher as claimed in claim 14, wherein said sheet edge sensor comprises two sheet edge sensors located outside of the opposite edges of the sheet.

18. The sheet finisher as claimed in claim 17, wherein said first motor drives said two sheet edge sensors at the same time.

* * * * *